US008607695B2

(12) United States Patent
Schwede

(10) Patent No.: US 8,607,695 B2
(45) Date of Patent: Dec. 17, 2013

(54) STRAP DRIVING DEVICE FOR A STRAPPING MACHINE

(75) Inventor: Roland Schwede, Goldkronach (DE)

(73) Assignee: SMB Schwede Maschinenbnau GmbH, Goldkronach (DE)

( * ) Notice: Subject to any disclaimer, the term of this patent is extended or adjusted under 35 U.S.C. 154(b) by 337 days.

(21) Appl. No.: 12/978,026

(22) Filed: Dec. 23, 2010

(65) Prior Publication Data

US 2011/0146505 A1 Jun. 23, 2011

(30) Foreign Application Priority Data

Dec. 23, 2009 (DE) ..... 10 2009 055 313

(51) Int. Cl.
*B65B 13/04* (2006.01)

(52) U.S. Cl.
USPC ..... 100/26; 100/29

(58) Field of Classification Search
USPC ..... 100/26, 29, 32; 53/589
See application file for complete search history.

(56) References Cited

U.S. PATENT DOCUMENTS

| | | | | |
|---|---|---|---|---|
| 5,111,634 | A | 5/1992 | Rauch | |
| 5,718,167 | A * | 2/1998 | Renz et al. | 100/29 |
| 5,791,238 | A | 8/1998 | Garbotz | |
| 7,377,213 | B1 * | 5/2008 | Haberstroh et al. | 100/29 |
| 7,395,754 | B1 * | 7/2008 | Bobren et al. | 100/26 |
| 7,677,168 | B1 * | 3/2010 | Liu et al. | 100/26 |

FOREIGN PATENT DOCUMENTS

| | | | |
|---|---|---|---|
| DE | 196 02 579 | A1 | 7/1997 |
| DE | 20 2007 017208 | U1 | 3/2008 |
| DE | 20 2009 001998 | U1 | 6/2009 |
| EP | 0 445 429 | B1 | 9/1991 |
| EP | 1489012 | A1 | 12/2004 |

OTHER PUBLICATIONS

Machine translation of DE 20 2009 001 998 (listed in IDS filed on Dec. 23, 2010).*
Search Report, German Patent Office.

* cited by examiner

*Primary Examiner* — Dana Ross
*Assistant Examiner* — Leonel Vasquez
(74) *Attorney, Agent, or Firm* — Browdy and Neimark, PLLC

(57) ABSTRACT

A strap driving device for a strapping machine including an insertion-return unit; a tensioning unit; and guide channel portions for the strap which lead toward the device for inserting, returning and tensioning the strap and away from the strap driving device, with the guide channel portions being provided with cheeks guiding the strap along both sides of its flat sides, wherein rollers on one side of the insertion, return and tensioning unit and the cheeks of the guide channel portions are mounted preferably in a stationary manner on the same side while the cheeks of the guide channel portions on the other side are mounted on a movable carrier which is displaceable, using an actuation device, between a working position with closed pairs of rollers and guide channel portions and a service position with open pairs of rollers and guide channel portions.

13 Claims, 3 Drawing Sheets

STRAP DRIVING DEVICE FOR A STRAPPING MACHINE

BACKGROUND OF THE INVENTION

1. Field of the Invention

The invention relates to a strap driving device for a strapping machine comprising a device for inserting, returning and tensioning a strap, the device having at least one pair of rollers through which the strap is drivably guided in and opposite to the insertion direction and is tensionable around the object in the strapping machine opposite to the insertion direction, and guide channel portions for the strap which lead toward the device for inserting, returning and tensioning the strap and away from said device, with the guide channel portions being provided with cheeks guiding the strap along both sides of its flat sides.

2. Background Art

A strapping machine is for example disclosed in DE 196 02 579 A1. Along with the components which are usually present in such machines such as machine frame, work table, and strap guide frame for guiding the strap around the object to be strapped in the form of a loose loop, the strapping machine comprises a strap driving device disposed underneath the work table. Said strap driving device comprises a combined device for inserting, returning and tensioning the strap.

Practically speaking, an insertion-return unit for inserting the strap into the strap guide frame and for returning the strap from the strap guide frame until the strap is disposed around the object to be strapped as well as a tensioning unit for tautening the strap around the object are provided to achieve this purpose, with the tensioning unit being in many cases dependent on the stack height.

The insertion-return unit comprises a pair of rollers, with the strap being guided through the roller gap thereof in such a way as to be drivable by one of the rollers in the insertion and return directions. The tensioning unit comprises another pair of rollers, with the strap also being guided through the roller gap of which so as to be tensionable, by means of at least one of the rollers, in the return direction about the object to be strapped in the strapping machine.

For guiding the strap through the strap driving device, there are finally provided guide channel portions which guide the strap supplied by a supply roller or an intermediate storage device to the tensioning unit, between the tensioning unit and the insertion-return unit and from the insertion-return unit in the direction of the strap guide frame on the work table. The guide channel portions are in each case formed by cheeks guiding the strap along both sides of the flat sides, the cheeks being embodied as webs or lateral surfaces of larger prismatic bodies.

A major problem in the operation of strapping machines is the trouble-free handling of the strap which, in order to achieve high cycle times for the strapping process, needs to be guided through the strapping machine at high speeds before it is suddenly reversed in its direction of movement so as to come to a stop. Owing to the flexible nature of the strap or due to a wear of the machine or of the strap along the transport path, the strap may get stuck or tangled up along the transport path. The strap driving device is particularly susceptible to this kind of problem due to the fact that the drive rollers of the insertion-return unit and of the tensioning unit directly act on the strap in the strap driving device. The problem in this regard is that the various driving components of the strap driving device are arranged in a closely nested manner, making the strap very hard to access. In the event of heavy problems such as a so-called "Z-folding" of the strap where three strap layers are disposed on top of one another over a short distance, the strap may become "jammed" in the guide channel portions in such a way that it can no longer be pulled out. In order to resolve this problem in known strap driving devices, one or several cheeks of the guide channel portions or even rollers of the various driving units need to be dismounted. This, of course, results in a high machine downtime which may not only affect the strapping machine but, in the worst case, also an entire production line for print media, for example.

SUMMARY OF THE INVENTION

It is therefore the object of the invention to improve a strap driving device in such a way as to allow transport problems caused in the event the strap gets stuck to be resolved quickly and easily.

This object is achieved by a strap driving device for a strapping machine wherein the at least one roller on one side of the device for inserting, returning and tensioning the strap and the cheeks of the guide channel portions are mounted preferably stationarily on the same side while the at least one roller on the other side of said device and the cheeks of the guide channel portions on said other side are mounted on a movable carrier which is displaceable by means of an actuation device between a working position with closed pairs of rollers and guide channel portions and a service position with open pairs of rollers and guide channel portions. With respect thereto, it is provided according to the invention that the rollers on one side of the insertion, return and tensioning device as well as the cheeks of the guide channel portions are mounted preferably stationarily on the same side while the rollers on the other side of said device as well as the cheeks of the guide channel portions of said other side are mounted on a movable carrier which is displaceable, by means of an actuation device, between a working position with closed pairs of rollers and guide channel portions and a service position with open pairs of rollers and guide channel portions.

It is obvious that when the strap gets stuck in the actuation device, said actuation device can be opened by a simple action of the actuation device by displacing the movable carrier. The rollers and guide channel portions on one side of the transport path of the strap thus move away from the opposite machine elements into a service position where the strap can be tension-relieved and removed easily or reinserted in the correct position. Afterwards, it is sufficient to move the carrier back into the working position by means of the actuation device so that the transport path of the strap through the strap driving device is closed and the machine is operational again. There is no need for time-consuming assembly works, allowing malfunctions to be repaired extremely quickly.

Features, details and advantages of the strap driving device according to the invention will become apparent from the ensuing description of an embodiment by means of the drawing.

DESCRIPTION OF THE PREFERRED EMBODIMENT

Figure 1:
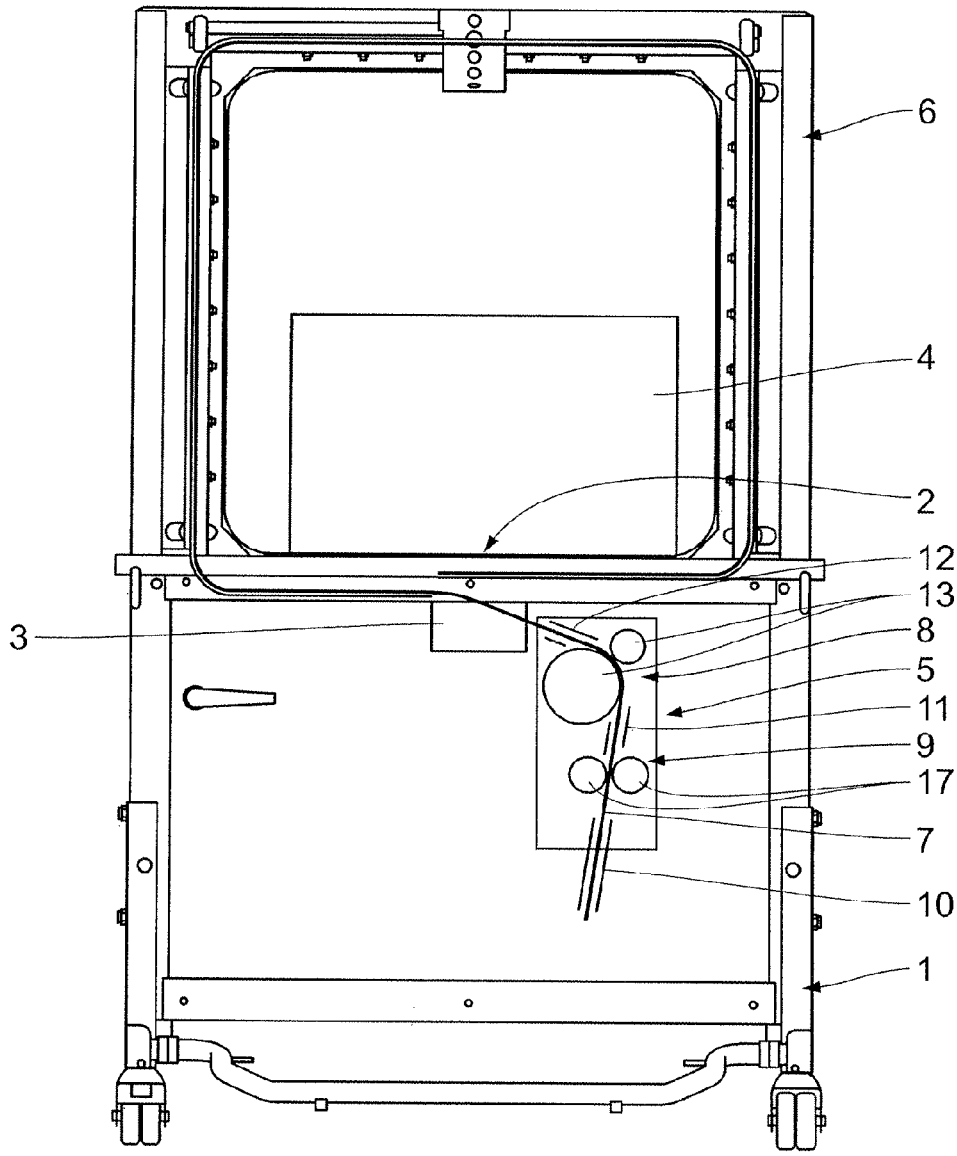
FIG. 1 shows a schematic side view of a strapping machine.

As shown in FIG. 1, the strapping machine comprises a machine frame 1 mounted on rollers, with a work table 2 being mounted on the machine frame 1. The work table 2 comprises conveyor belts (not shown) by means of which the object 4 to be strapped such as a stack of magazines according to FIG. 1 are transported to the strapping position on the work table 2. For so-called cross-strappings, the work table 2 may additionally be provided with an integrated turntable as disclosed in EP 0 445 429 B1.

On the work table 2 is arranged a vertical strap guide frame 6 by means of which the strap 7 may be guided around the object 4 on the work table 2 so as to form a loose loop. To this end, the strap 7, which is stored on a supply spool (not shown in more detail) on the side of the machine frame 1, is inserted into the strap guide frame 6 through the strap driving device 5 (only illustrated schematically in FIG. 1) underneath the work table 2 and through the welding head 3 of the strapping machine and is guided around said strap guide frame 6 until it arrives at the welding head 3 again. The strap end is fixed there, and the strap 7 is returned by means of the strap driving device 5, with the strap 7 passing out of the strap guide frame 6 so as to be disposed around the object 4 in the form of a still non-tensioned loop. Afterwards, the strap is tensioned by means of the strap driving device 5 so as to be tightly disposed around the object 4. The overlapping strap layers in the welding head 3 are for example thermally welded so that the thus formed strapping is separated from the strap. The object 4 is thus strapped and ready for transport.

Figure 2:
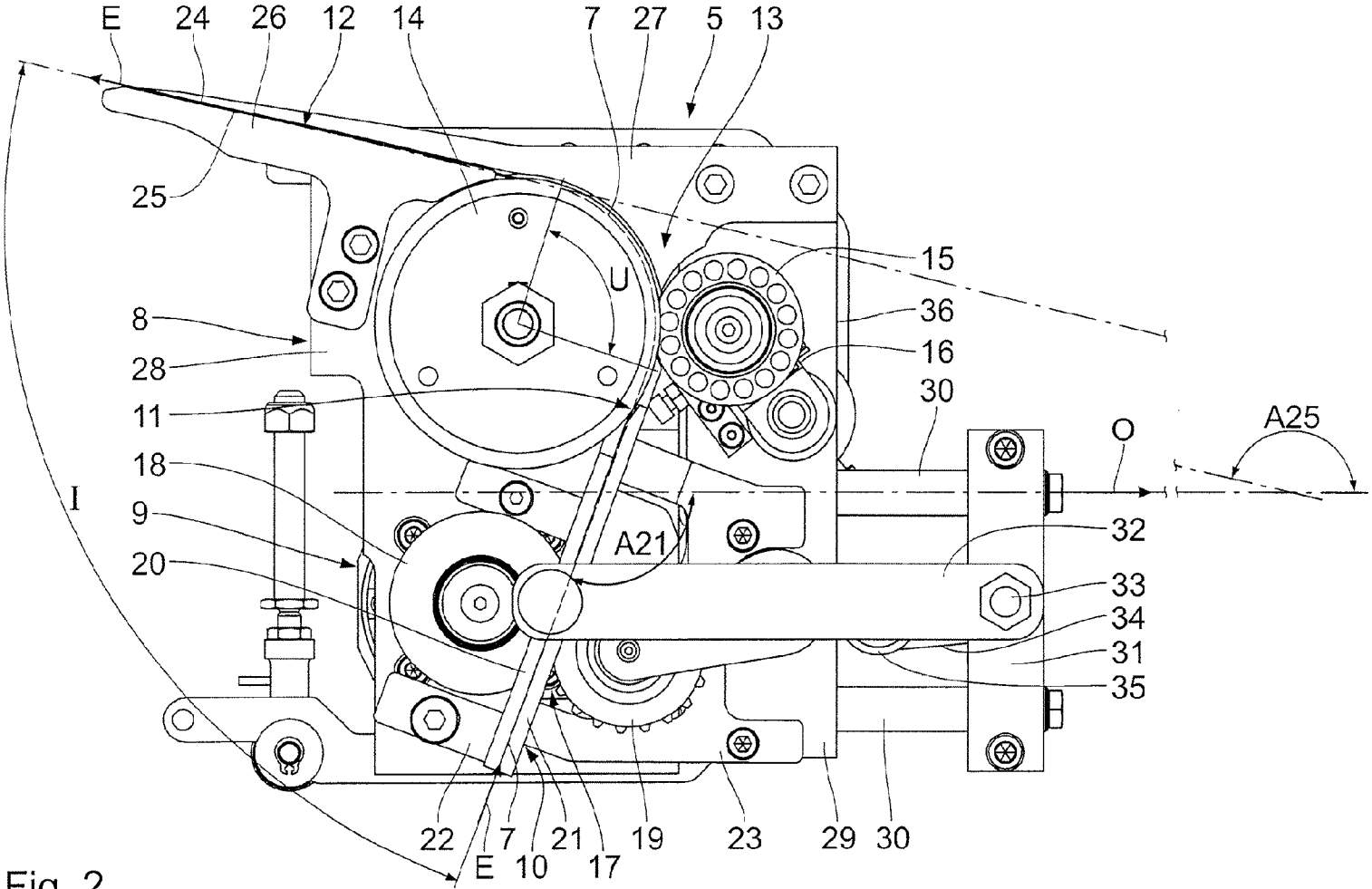
FIGS. 2 and 3 show a side view of a strap driving device of said strapping machine in the working position and in the service position.

The design of the strap driving device 5 is to be explained by means of FIG. 2. The main assemblies are the insertion-return unit 8 on the one hand and the tensioning unit 9 on the other hand which perform the above-explained manipulations of the strap 7 according to their designation.

Guide channel portions 10, 11, 12 are provided for forming a defined transport path for the strap 7 through the strap driving device 5. A first guide channel portion 10 guides the strap 7 arriving from the supply spool or the intermediate storage (neither of which is shown) to the tensioning unit 9. A second guide channel portion 11 connects the tensioning unit 9 and the insertion-return unit 8. A last guide channel portion 12 leads away from the insertion-return unit 8 in the direction of the welding head 3 and to the entrance point of the strap 7 into the strap guide frame 6.

The insertion-return unit 8 comprises a pair 13 of drive rollers with a roller 14 which is driven by a motor (not shown) and a pressure roller 15 which is not driven. The latter is coupled with an incremental encoder 16 for detecting the angular rotation performed by the pressure roller 15. Said angular rotation is a measure for the length of strap 7 transported by the pair 13 of drive rollers.

For inserting the strap 7, the roller 14 of the pair 13 of drive rollers is set in rotation in the corresponding direction by actuation of the drive motor via a control unit (not shown), and the strap 7 is guided around the strap guide frame 6 until the free end thereof comes to rest in the region of the welding head 3 where it is fixed. Afterwards, the pair 13 of drive rollers is activated in the opposite direction, causing the strap 7 to be returned in the manner described above.

The tensioning unit 9 comprises a rubberized pair 17 of tensioning rollers with rollers 18, 19 which are adapted to be coupled with each other, the pair 17 of tensioning rollers applying a high tensile force owing to its drive motor (not shown) for tensioning the strap 7 around the object 4 to be strapped.

The guide channel portions 10, 11 are formed by web-shaped cheeks 20, 21 which are guided across the rollers 18, 19 and are fixed in the strap driving device 5 by means of projecting retaining feet 22, 23 in a manner yet to be explained. The rollers 18, 19 penetrate through recesses in the cheeks 20, 21, the recesses not being shown in more detail in the drawing.

Likewise, the guide channel portion 12 is also formed by cheeks 24, 25 on both sides, with the one cheek 24 being formed by the lateral surface of a prismatic body 26 which is approximately T-shaped in a plan view. The other cheek 25 has a curved portion which is bent across a looping angle U for the strap 7 corresponding to the outer periphery of the roller 14 and continues in a straight portion. The cheek 25 is formed as a lateral surface at a corresponding longitudinal prismatic body 27.

The components of the strap driving device 5 adjoining the left-hand side—relative to the insertion direction E—of the strap 7, in other words the cheek 20, the rollers 14 and 18 as well as the cheek 24 are mounted stationarily on a mounting member 28 of the strap driving device 5. The components disposed on the right-hand side—relative to the insertion direction E—of the strap 7, in other words the cheek 21, the roller 19, the pressure roller 15 and the cheek 25 on the other hand are mounted on a movable slide 29 serving as carrier which is mounted for displacement in the opening direction O. To this end, said slide 29 is mounted on two bars 30 serving as linear guides running parallel to the opening direction O, with the ends of the bars 30 being mounted in a socket member 31 designed as a vertically arranged cross-bar.

Instead of the linear opening assembly, there may also be provided a corresponding pivoting mechanism allowing the carrier to be pivoted away over a large radius.

Figure 3:
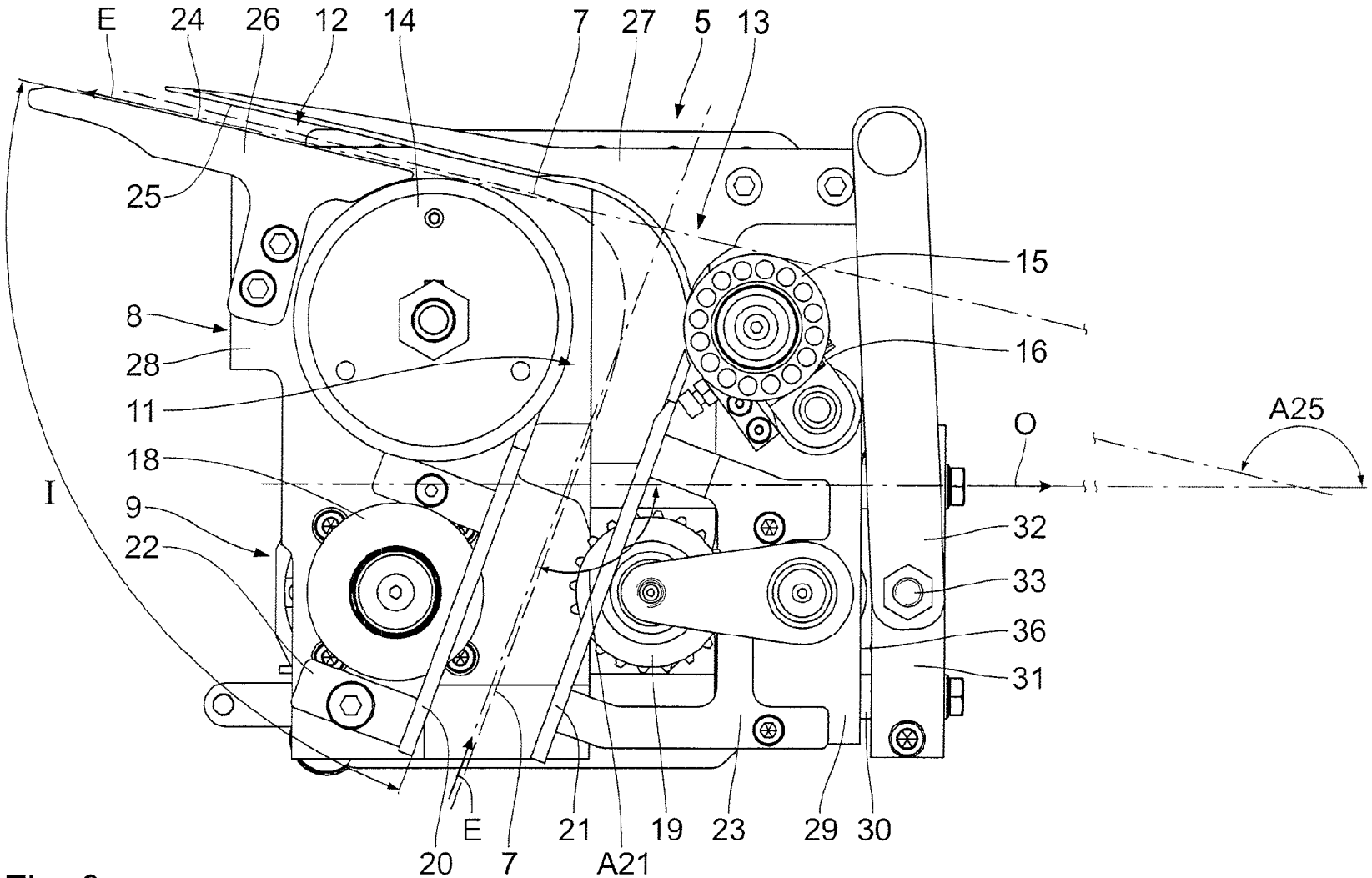

In order to move the slide 29 from the working position shown in FIG. 2 into the service position shown in FIG. 3, an actuation device in the form of a hand-operable, single-arm pivot lever 32 is provided the fixed end of which is pivot-mounted in the socket member 31 via a shaft 33. The pivot lever 32 is disposed in front of the strap driving device 5 in a well-accessible manner and protrudes horizontally beyond the pair 17 of rollers in the working position shown in FIG. 2.

The pivot lever 32 could also be actuated automatically, for instance when opening the door of the machine.

On the rear side of the socket member 31 not visible in FIGS. 2 and 3, a much shorter auxiliary lever 34 is also mounted to the shaft 33 and therefore coupled with the pivot lever 32. The auxiliary lever 34 is a single-arm lever as well, comprising a pressure roller 35 on its free end which acts on the outside 36 of the slide 29 in a direction opposite to the opening direction O.

It is conceivable as well to use an eccentric or an articulated lever according to the knee lever principle instead of the auxiliary lever 34.

The auxiliary lever 34 can be moved away from the slide 29, causing the latter to be pulled outward in the opening direction O, by pivoting the pivot lever 32 from the pressure position of the pivot lever 32 shown in FIG. 2 where the slide 29 is acted upon by the auxiliary lever 34 in the working position, in other words transport path for the strap 7 is closed and operational, into the release position of the auxiliary lever 34 shown in FIG. 3. In the service position thus assumed according to FIG. 3, the cheeks 25, 21, the rollers 19 and the pressure roller 15 are positioned at a significant distance from the opposite components of the guide rail of the strap 7, allowing a piece of strap 7 which is stuck there to be easily removed or aligned.

The arrangement of the various angles of the guide channel portions 10, 11, 12 relative to the opening direction O deserves particular attention. The strap driving device 5 generally opens from the working position into the service position if the external angles A21 and A25 of the cheeks 21, 25 amount to approximately 10° to 170° relative to the opening direction O. In the illustrated embodiment, the external angle A21 is up to approx. 115° while the external angle A25 is at 167°. Another basic principle for arranging the guide channel portions 10, 11, 12 in order to ensure a functional opening of the strap driving device 5 in the event of a looping angle U of the strap 7 around the roller 14 of the pair 13 of drive rollers is that the internal angle I between the stationary cheeks 20 and 24 of the guide channel portions 10 or 11/12, respectively, opens in the direction opposite to the opening direction O of the slide 29. In this case, the displaceable cheeks 21, 25 as well as the pressure roller 15 and roller 19 can be pulled away from the corresponding opposite components in the opening direction O.

What is claimed is:

1. A strap driving device for a strapping machine, comprising a device (8, 9) for inserting, returning and tensioning a strap, the device (8, 9) having at least one pair (13, 17) of rollers (14, 15, 18, 19) through which the strap (7) is drivably guided in an insertion direction (E) and opposite to the insertion direction (E) and is tensionable around the object (4) in the strapping machine opposite to the insertion direction (E);

guide channel portions (10, 11, 12) for the strap (7) which lead toward the device (8, 9) for inserting, returning and tensioning the strap (7) and which further on lead away from said device (8, 9), with the guide channel portions (10, 11, 12) being provided with cheeks (20, 21, 24, 25) guiding the strap (7) along both sides of its flat sides, wherein the at least one roller (14, 18) on one side of the device (8, 9) for inserting, returning and tensioning the strap (7) and the cheeks (20, 24) of the guide channel portions (10, 11, 12) are mounted on the same side while the at least one roller (15, 19) on the other side of said device (8, 9) and the cheeks (21, 25) of the guide channel portions (10, 11, 12) on said other side are mounted on a movable carrier which is displaceable in an opening direction (O) by means of an actuation device (32, 33, 34) between a working position with closed pairs (13, 17) of rollers and guide channel portions (10, 11, 12) and a service position with open pairs (13, 17) of rollers and guide channel portions (10, 11, 12) and wherein the movable carrier is a slide (29) which is mounted for displacement on a linear guide (30) running parallel to the opening direction (O).

2. A strap driving device according to claim 1, wherein the at least one roller (14, 18) on one side of the device (8, 9) for inserting, returning and tensioning the strap (7) and the cheeks (20, 24) of the guide channel portions (10, 11, 12) are mounted in a stationary manner on the same side.

3. A strap driving device according to claim 1, wherein the device (8, 9) for inserting, returning and tensioning a strap (7) comprises an insertion-return unit (8) comprising a first pair (13) of rollers through which the strap (7) is drivably guided by at least one of the rollers (14) in the insertion direction (E) and opposite to the insertion direction (E); and a tensioning unit (9) comprising a second pair (17) of rollers (18, 19) through which the strap (7) is tensionable around the object (4) to be strapped in the strapping machine opposite to the insertion direction (E) by at least one of the rollers (18).

4. A strap driving device according to claim 3, wherein a first one (10) of the guide channel portions (10, 11, 12) for the strap (7) leads to the tensioning unit (9), a second one (11) of the guide channel portions (10, 11, 12) connects said tensioning unit (9) and the insertion-return unit (8) and a third one (12) of the guide channel portions (10, 11, 12) leads away from said tensioning unit (9).

5. A strap driving device according to claim 1, wherein the actuation device comprises a pivot lever (32) which is pivotable between a pressure position acting upon the slide (29) in the working position and a release position where the slide (29) is being released into the service position.

6. A strap driving device according to claim 5, wherein the pivot lever (32) is hand-operable.

7. A strap driving device according to claim 5, wherein the pivot lever (32) acts upon the slide (29) via an auxiliary lever (34) disposed on a common shaft (33).

8. A strap driving device according to claim 7, wherein the shaft (33) is pivotably mounted in a socket member (31) to which the linear guide (30) is mounted.

9. A strap driving device according to claim 8, wherein the linear guide is formed by one guide bar (30).

10. A strap driving device according to claim 9, wherein the linear guide is formed by at least two parallel guide bars (30).

11. A strap driving device according to claim 1, wherein the rollers (15, 19) mounted on the movable carrier act as pressure rollers of the pairs (13, 17) of rollers of the insertion-return unit (8) and the tensioning unit (9).

12. A strap driving device according to claim 1, wherein external angles (A1, A2) between the opening cheeks (21, 25) of the guide channel portions (10, 11, 12) and the opening direction (O) amount to approximately 10° to 170°.

13. A strap driving device according to claim 1, wherein the strap (7) is guided around the stationary drive roller (14) of the insertion-return unit (9) in a looping angle (U) in such a way that an internal angle (I) between the stationary cheeks (20, 24) of the guide channel portions, which are disposed on both sides of the insertion-return unit (9), opens in a direction opposite to the opening direction (O) of the carriers.

* * * * *